US005868286A

United States Patent [19]

Mascitelli

[11] Patent Number: 5,868,286

[45] Date of Patent: Feb. 9, 1999

[54] MANUAL DISPENSER DEVICE TO BE APPLIED WITH NO GASKET TO THE MOUTH OF A BOTTLE

[75] Inventor: Francesco Mascitelli, Pescara, Italy

[73] Assignee: SAR S.p.A., San Giovanni Teatino, Italy

[21] Appl. No.: 981,460

[22] PCT Filed: Mar. 28, 1997

[86] PCT No.: PCT/IT97/00071

§ 371 Date: Dec. 19, 1997

§ 102(e) Date: Dec. 19, 1997

[87] PCT Pub. No.: WO97/40945

PCT Pub. Date: Nov. 6, 1997

[30] Foreign Application Priority Data

Apr. 30, 1996 [IT] Italy ..... RM96A0293

[51] Int. Cl.[6] ..... B65D 88/54

[52] U.S. Cl. ..... 222/321.9; 222/542

[58] Field of Search ..... 222/321.7, 321.9, 222/542

[56] References Cited

U.S. PATENT DOCUMENTS 3,907,174 9/1975 Steiman .

FOREIGN PATENT DOCUMENTS 1 476 608 6/1967 France .

*Primary Examiner*—Gregory L. Huson

*Attorney, Agent, or Firm*—Browdy and Neimark

[57] ABSTRACT

A manual liquid dispenser (1) for a liquid dispensing bottle (3) is held fast to the threaded bottle neck (5) by a ring nut (4). The hollow pump body (6) includes inside the top end a folded-back lip (16) with an inverted V cross section. The V cross section has inclined outer (16*a*) and inner (16*b*) portions; the inner side of each is in circumference contact with one side of the bottle mouth rim (2). The folded-back lip (16) may have a flat bottom (16*c*) between the inner and outer portions. The outer portion preferably is inclined, making a conical surface that engages the internal lateral profile (4*a*) of the ring nut (4). The pump body (6) has a check valve (9) at the first end (7). An outflow push-button (11) is mounted on the end of a movable hollow stem (10) which protrudes through the second end (8) of the pump body. The stem drives a piston (12) within a pressure chamber (14).

6 Claims, 1 Drawing Sheet

MANUAL DISPENSER DEVICE TO BE APPLIED WITH NO GASKET TO THE MOUTH OF A BOTTLE

The present invention relates to a manual dispenser device to be applied with no gasket to the mouth of a bottle containing a more or less dense liquid substance, pump which is held fast thereto by a ring nut mounted on the threaded neck of said bottle.

The manual pump of the type mentioned above comprises a hollow body, with check valve; a hollow stem, movable coaxially to said hollow body, bearing an outflow push-button; a piston, inserted on said stem and movable within said hollow body, in which it defines a pressure chamber; separate elastic return means for said stem and said piston; an annular element closing the hollow body.

Dispenser devices of the prior art present a hollow body whose upper portion is shaped, in the vicinity of the outflow push-button, into an edge with radial development destined to be held against the rim of the mouth of the bottle by a ring nut screwed on to the threaded neck of the bottle. In certain embodiments, this edge of the hollow body is flat and it is destined to rest on an annular gasket placed on the mouth of the bottle. In other embodiments, this edge of the hollow body has a lip whose free end is set against the rim of the mouth of the bottle.

In the embodiments with gasket, the seal preventing leakage of the more or less dense liquid substance contained in the bottle is satisfactory, but the inclusion of the gasket increases manufacturing and assembly costs. In particular, the gasket is generally made of an elastic material, which differs from the other plastic materials making up the pump and the bottle, resulting in differentiated recycling problems.

In the embodiments with rabbet lip, the seal is generally less satisfactory, especially in that it entails the accurate machining of the surface of the mouth rim, in which the seal is essentially linear.

The latter type of embodiment mentioned above, however, presents the problem that the radially developed edge of the hollow body of the pump must be dimensioned to fit the particular bottle mouth. However, commercially available bottles, even of the same type and size, may present dimensional or shape differences also in their mouth profile, and thus different pump hollow bodies, if not indeed different pumps, must be provided for the various commercial bottle mouth sizes.

The purpose of the present invention is therefore to eliminate the drawbacks mentioned above.

In particular, the purpose of the present invention is to achieve a better seal between hollow body and bottle, without adding different means, such as gaskets and the like, and without entailing an increase in manufacturing costs.

Yet another purpose of the present invention is to embody dispenser devices destined to be applied with their hollow bodies on to a wide range of bottle mouth sizes, with the resulting reduction in production costs.

The invention, as characterised by the claims which follow, solves the problem of providing a manual dispenser device to be applied with no gasket to the mouth of a bottle containing a more or less dense liquid substance, and held fast thereto by a ring nut mounted on the threaded neck of said bottle, the pump being of the type comprising an essentially cylindrical hollow body, open at its ends, with a check valve being fitted in correspondence with a first end; a hollow stem, movable coaxially to said hollow body, an end of said stem, protruding outside through the second end of said hollow body, bearing an outflow push-button; a piston, inserted on said stem and movable within said hollow body, the internal part of the hollow body between said piston and said check valve defining a pressure chamber; at least one elastic return means for said stem and said piston; an annular element closing said second end of said hollow body, said closing element also serving as a guide for said stem, which in general is characterised in that said hollow pump body presents at its top, in proximity of its said second end, a folded-back lip shaped into an inverted V cross section and circumscribing said bottle neck mouth, by means of one of its portions inclined outward and one of its portions inclined inward, with respect to said body, portions which are respectively in circumference contact, in their internal sides, with an external rim and with an internal rim of said mouth.

Additional characteristics and advantages of the present invention shall be made clearer in the detailed description that follows, of a preferred form of embodiment illustrated purely by way of indicative but non limiting example in the accompanying drawings in which.

Figure 1:
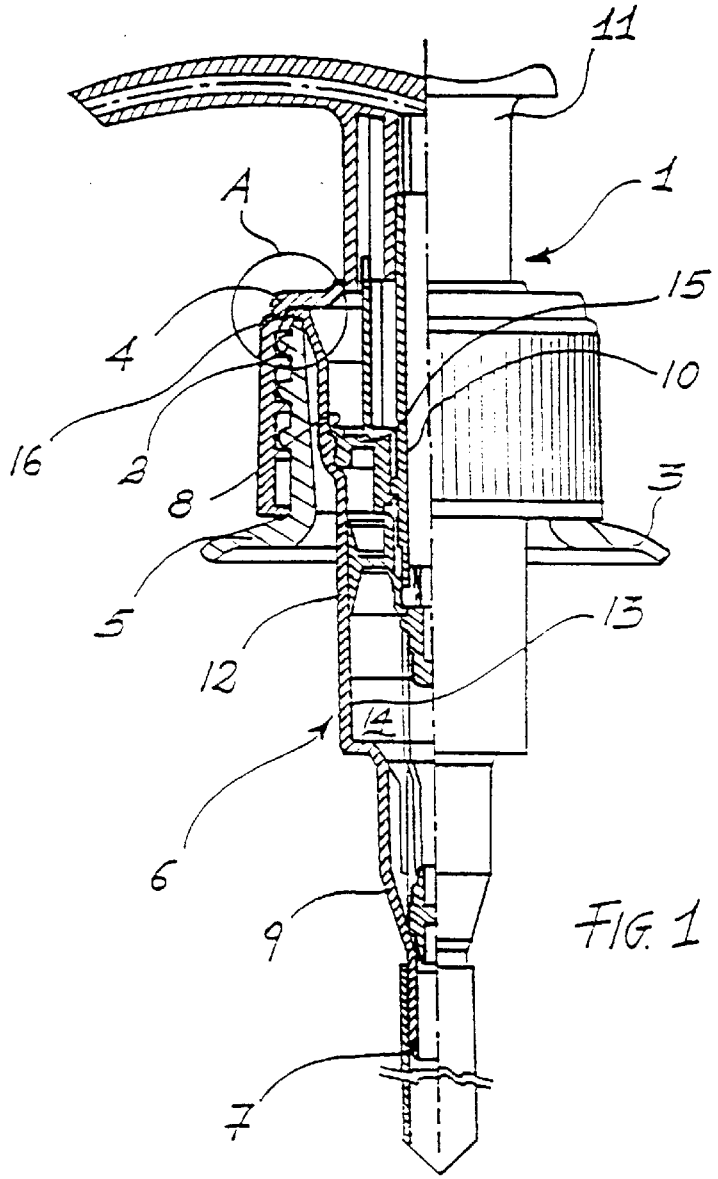
FIG. 1 illustrates, half in central longitudinal section and half in vertical view, a dispenser device according to the present invention.

In accordance with the present invention, the figures indicate as 1 the whole of a manual dispenser device to be applied with no gasket to a mouth 2 of a bottle 3, held fast thereto by a ring nut 4 mounted on the threaded neck 5 of the bottle 3.

Traditionally, the pump 1 comprises in general a hollow body 6, which is essentially cylindrical with different diameters, and is open at its ends, which are a first end, referred to hereafter as bottom end 7, and a second end, or top end 8, as a result of the relative position with respect to bottle 3 after mounting on the mouth 2 of the bottle. In correspondence with the bottom end 7 is fitted a check valve 9. The pump 1 also comprises a hollow stem 10, movable coaxially on the hollow body 6. The end of the stem 10, protruding outside through the top end 8 of the hollow body 6, bears an outflow push-button 11.

On the hollow stem 10 is inserted a piston 12, movable within the hollow body 6. The internal part 13 of the hollow body 6 between the piston 12 and the check valve 9 defines a pressure chamber 14.

As is well known, though they are not represented in the figures, elastic return means are provided, in the form of helical springs for the stem 10 and the piston 12. Their operation is known, so they are not described further. Lastly, there is an annular element 15 for closing the top end 8 of the hollow body 6, which closure element 15 also serves as a guide for the stem 10.

Figure 2:
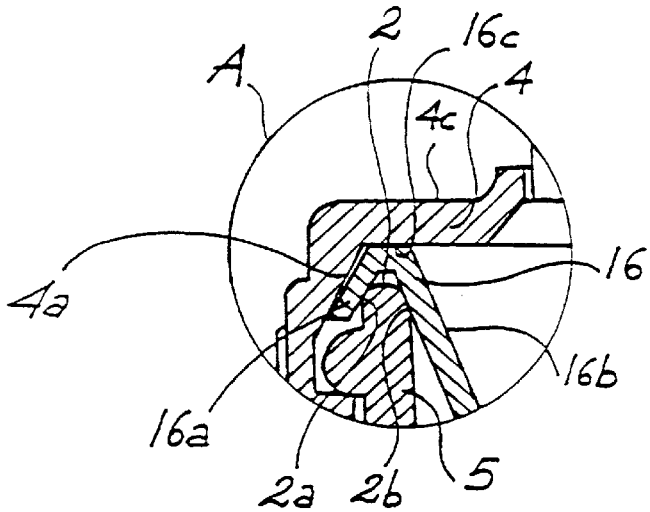
FIG. 2 illustrates in enlarged section a detail A of FIG. 1.

According to the present invention, the hollow body 6 of the pump 1 presents in proximity of its top end 8 a folded-back lip 16 whose cross section is shaped as an inverted V. This folded-back lip 16 circumscribes the bottle mouth 2, by means of its first portion 16*a* inclined outward and its second portion 16*b* inclined inward, with respect to the body 6. When mounted on to the bottle mouth 2, the portions 16*a*, 16*b* of the folded-back lip of the hollow body are respectively in contact, in their internal sides, with an external rim 2*a* and an internal rim 2*b* of the mouth 2. The folded-back lip 16 preferably has a flat bottom 16*c*, but this bottom could also be embodied as a sharp edge (not represented). In the cross-sectional view of FIG. 2, the outer edge of lip portion 16*a* is depicted by a straight line. It is evident that the outer surface of the lip portion 161 is generally conical.

In particular, the portion 16*a* inclined outward approximately presents, on the external side, an inclination corresponding to that of an internal lateral profile 4*a* of the ring nut 4. The flat bottom 16*c* of the folded-back lip 16 is destined to be set against an internal base profile 4*c* of the ring nut 4.

By way of non limiting indication, the inclination of the portion 16*a* inclined outward is at an angle of about 45°, whereas the inclination of the portion 16*b* inclined inward is at an angle of about 30°.

The invention thus conceived can be subject to numerous modifications and variations without thereby departing from the scope of the inventive concept. Moreover, all components may be replaced with technically equivalent elements. In practice, modifications and/or improvements are clearly possible, without thereby departing from the scope of the claims that follow.

I claim:

1. A manual dispenser device to be applied with no gasket to the mouth (2) of a bottle (3) adapted to contain a dense liquid substance, and held fast to the mouth by a ring nut (4) mounted on to a threaded neck (5) of the bottle (3), the pump comprising:

an essentially cylindrical, hollow pump body (6) open at pump body ends (7, 8) thereof, the pump body ends including a first end (7) and a second end (8);

a check valve (9) in correspondence with the first end (7);

a hollow stem (10), movable coaxially to said hollow pump body (6), the stem including a stem end protruding outside through the second end (8) of said hollow pump body (6) and bearing an outflow push-button (11);

a piston (12), coupled to said stem (10) and movable within said hollow pump body (6), wherein an internal part (13) of the hollow pump body (6) disposed between said piston (12) and said check valve (9) defines a pressure chamber (14);

an elastic return means for said stem and said piston;

an annular closure element (15) for closing said second end (8) of said hollow pump body (6), said closure element (15) acting as a guide for said stem (10);

wherein said hollow pump body (6) includes at a top thereof, the top being in proximity to the second end (8), a folded-back lip (16) shaped into an inverted V cross section and circumscribing said mouth (2) of the bottle neck (5), the V cross section comprising an outer portion (16*a*) inclined outwardly with respect to said hollow pump body (6) and an inner portion (16*b*) inclined inwardly with respect to said hollow pump body (6), the inner portion (16*a*) and the outer portion (16*b*) having inner sides respectively in circumference contact with an external rim (2*a*) and an internal rim (2*b*) of said mouth (2).

2. The device according to claim 1, wherein said folded-back lip (16) of the hollow pump body (6) includes a flat bottom (16*c*) disposed between said outer portion (16*a*) inclined outwardly and said inner portion (16*b*) inclined inwardly.

3. The device according to claim 1, wherein said outer portion (16*a*) inclined outwardly of said hollow pump body includes, on an outer side thereof, an inclination substantially corresponding to an inclination of an internal lateral profile (4*a*) of said ring nut (4).

4. The device according to claim 1, the wherein an outer side of the outer portion (16*a*) comprises a generally conical outer surface.

5. The device according to claim 4, wherein an inclination of the outer surface is inward.

6. The device according to claim 4, wherein the folded-back lip includes a substantially constant thickness, whereby the inner portion (16*b*) and the outer portion (16*a*) comprise arms of the inverted V cross section and the arms are generally equal in thickness.

* * * * *